US012427621B2

(12) United States Patent
Sato

(10) Patent No.: US 12,427,621 B2
(45) Date of Patent: Sep. 30, 2025

(54) PLANE POLISHING MACHINE

(71) Applicant: NORITAKE CO., LIMITED, Nagoya (JP)

(72) Inventor: Makoto Sato, Nagoya (JP)

(73) Assignee: NORITAKE CO., LIMITED, Nagoya (JP)

( * ) Notice: Subject to any disclaimer, the term of this patent is extended or adjusted under 35 U.S.C. 154(b) by 308 days.

(21) Appl. No.: 18/125,198

(22) Filed: Mar. 23, 2023

(65) Prior Publication Data

US 2023/0321787 A1 Oct. 12, 2023

(30) Foreign Application Priority Data

Mar. 23, 2022 (JP) ..... 2022-047557

(51) Int. Cl.
*B24B 47/28* (2006.01)
*B24B 37/10* (2012.01)
*B24B 47/12* (2006.01)

(52) U.S. Cl.
CPC ..... *B24B 47/28* (2013.01); *B24B 37/107* (2013.01); *B24B 47/12* (2013.01)

(58) Field of Classification Search
CPC ..... B24B 37/102; B24B 37/105; B24B 37/32; B24B 7/228; B24B 47/12; B24B 47/28
USPC ..... 451/269, 270, 271, 286
See application file for complete search history.

(56) References Cited

U.S. PATENT DOCUMENTS 3,004,371 A * 10/1961 Layton ..... B24B 37/102 451/283
6,280,296 B1 8/2001 Sato et al.
7,399,217 B1 * 7/2008 Godshall ..... B24B 47/12 451/262
8,398,456 B2 * 3/2013 Kobayashi ..... B24B 49/00 451/6
8,414,360 B2 * 4/2013 Lee ..... B24B 37/08 451/400
2015/0065010 A1 * 3/2015 Miura ..... B24B 37/013 451/262

FOREIGN PATENT DOCUMENTS

JP 3511584 B2 3/2004
JP 4342012 B2 10/2009

* cited by examiner

*Primary Examiner* — Makena S Markman
(74) *Attorney, Agent, or Firm* — Oliff PLC

(57) ABSTRACT

A plane polishing machine polishing one surface of a workpiece flat, the plane polishing machine comprises a stick-on disk decentering jig of a circular plate shape mounted on a rotating polishing surface plate, a jig rotation drive device having a plurality of guide rollers coming into contact with the stick-on disk decentering jig, a rotational direction restriction device permitting rotation of the stick-on disk in a direction identical to a rotational direction of the stick-on disk decentering jig and inhibiting rotation of the stick-on disk in a direction opposite to the rotational direction of the stick-on disk decentering jig, and a jig rotation suppression device periodically suppressing rotation of the stick-on disk decentering jig rotated by the drive guide roller, for a predetermined period.

7 Claims, 8 Drawing Sheets

FIG.11

| | POLISHING PAD | POLISHING SOLUTION | EMBODIMENT (MACHINE) | SECTION PROFILE PV VALUE |
|---|---|---|---|---|
| COMPARISON-EXAMPLE TEST 1 | FOAMED POLYURETHANE PAD | CERIA SLURRY (5 WT%) | WITHOUT REVOLUTION | 2.80μm |
| COMPARISON-EXAMPLE TEST 2 | SEMI-FIXED ABRASIVE PAD | WATER | WITH REVOLUTION | 0.40μm |
| EXAMPLE TEST 1 | FOAMED POLYURETHANE PAD | CERIA SLURRY (5 WT%) | WITHOUT REVOLUTION | 0.63μm |
| EXAMPLE TEST 2 | SEMI-FIXED ABRASIVE PAD | WATER | WITH REVOLUTION | 0.25μm |

FIG.12

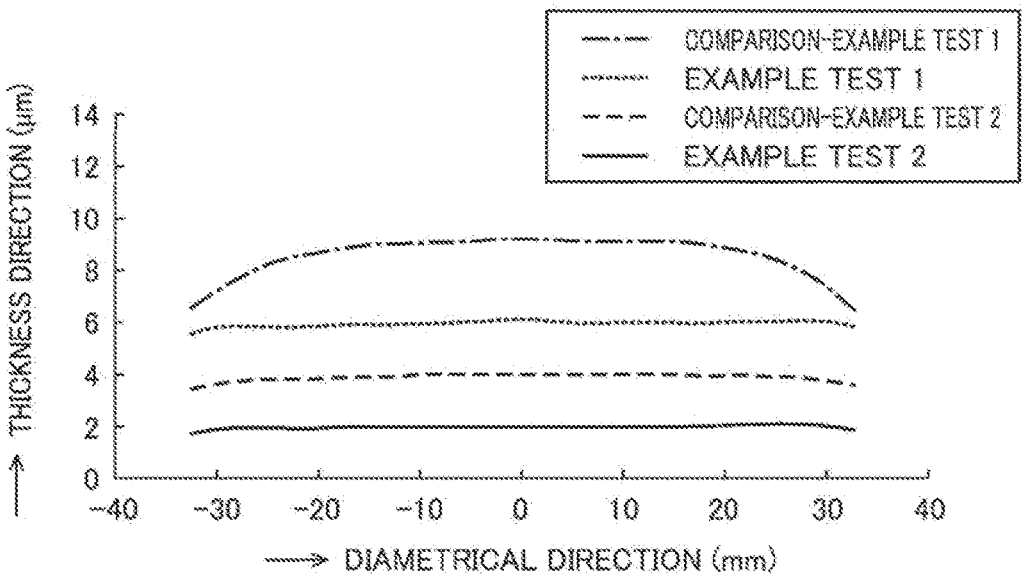

PLANE POLISHING MACHINE

This application claims priority from Japanese Patent Application No. 2022-047557 filed on Mar. 23, 2022, the disclosure of which is herein incorporated by reference in its entirety.

BACKGROUND OF THE INVENTION

Field of the Invention

The present invention relates to a plane polishing machine for use in mirror-polishing one surface of a workpiece such as a semiconductor substrate, and to a technique enabling a high flatness to be implemented by a simple machine.

Description of the Related Art

In cases where the workpiece is a semiconductor substrate like a monocrystalline wafer of e.g. silicon, gallium arsenide, or indium phosphide (InP), it is desirable that after being sliced from an ingot, the workpiece be mirror-polished with a high flatness (degree of flatness) by a plane polishing machine.

Generally, in case of plain-polishing one surface of a workpiece, a plane polishing machine 100 has been used that does not use a stick-on disk decentering jig, e.g. as shown in FIGS. 9 and 10. In the plane polishing machine 100, when a stick-on disk 120 with a workpiece (object to be machined) 116 stuck on its bottom surface is mounted on a polishing surface plate in rotation or a polishing pad 112 in rotation, a pair of idle guide rollers 140 disposed on a guide roller fixing base 138 come into contact with the stick-on disk 120 in such a manner as to allow the stick-on disk 120 to pivot, and the stick-on disk 120 is pressed against the polishing surface plate or the polishing pad 112 by a load of e.g. a weight 122 while allowing the stick-on disk 120 to pivot with a rotational force based on the peripheral speed difference between the stick-on disk 120 and the polishing surface plate or the polishing pad 112, to consequently perform polishing. In this case, however, the outer peripheral part of one surface of the workpiece 116 undergoes promoted polishing as compared with the inner peripheral part thereof, so that the outer peripheral part of the workpiece is apt to be polished thin with the workpiece rotation center and its vicinity polished thick. Such a tendency becomes remarkable in case of polishing using a soft polishing pad or an abrasive-grain-containing slurry (loose abrasive grains).

On the other hand, a plane polishing machine is conceivable that plain-polishes a workpiece stuck on the bottom surface of the stick-on disk by using a stick-on disk decentering jig (carrier) rotationally driven around a second rotation center parallel to a first rotation center of the polishing surface plate by guide rollers. In this case, the stick-on disk is caused to pivot and revolve since the stick-on disk is rotated on the basis of the difference in frictional force based on the peripheral speed difference between the inner peripheral side and the outer peripheral side of the stick-on disk received from the polishing surface plate or the polishing pad, attendant on rotation of the stick-on disk decentering jig with the stick-on disk being fitted in the eccentric aperture formed through the stick-on disk decentering jig. In this case, there is a drawback that the high flatness may not be obtained reliably, because the stick-on disk is caused to rotate by the course of nature on the basis of the frictional force difference between the inner peripheral side and the outer peripheral side received from the polishing surface plate or the polishing pad, without rotational control of the stick-on disk.

A plane polishing machine is thus proposed that causes the stick-on disk with the workpiece (object to be machined) stuck on its bottom surface to pivot and revolve reliably. For example, concurrently with rotationally driving at least one of a pair of guide rollers coming into contact with the stick-on disk that is mounted on the polishing surface plate or the polishing pad and that is about to move together with that polishing surface plate or polishing pad, a guide roller support base rotatably supporting the guide rollers is revolved together with the guide rollers along a revolution trajectory, whereby the stick-on disk is pivoted and revolved reliably, obtaining a high flatness on the polished surface that is one surface of the workpiece. Examples of such a plane polishing machine are described in JP4342012 and JP3511584.

The plane polishing machines described in JP4342012 and JP3511584, however, necessitate attachment of dedicated devices for pivoting and revolving the stick-on disk, whereupon it is necessary to modify the polishing machine itself, resulting in a problem that high equipment costs are required.

A plane polishing machine is also conceivable that reciprocates the guide roller support base in a direction parallel to a straight line joining the center of the stick-on disk and the center of the polishing surface plate or the polishing pad, instead of revolving it together with the guide rollers along the revolution trajectory. Although such a plane polishing machine also ensures a high flatness similarly to the plane polishing machines described in JP4342012 and JP3511584, the plane polishing machine itself needs to be modified due to the necessity to attach dedicated devices for pivoting and reciprocating the stick-on disk, requiring high equipment costs.

SUMMARY OF THE INVENTION

The present invention was conceived in view of the above circumstances and its object is to provide an inexpensive plane polishing machine capable of obtaining a high flatness on a polished surface.

Against the background of the above circumstances, the inventor has found that a high flatness is obtained on a polished surface, by using a stick-on disk decentering jig (carrier) rotationally driven along the predetermined revolution trajectory, without using a rotation drive device for rotationally driving a stick-on disk for modification of the plane polishing machine that plane-polishes a workpiece stuck on the bottom surface of the stick-on disk. That is, the inventor has found that a high flatness equivalent to JP4342012 and JP3511584 is obtained without requiring high equipment costs, by disposing a rotational direction restriction device that permits rotation of the stick-on disk in the direction identical to the rotational direction of the rotating stick-on disk decentering jig stick-on disk and a device for desynchronizing the rotational periods of rotation of the stick-on disk decentering jig, i.e., revolution of the stick-on disk, and the pivoting of the stick-on disk. The present invention was conceived based on such a knowledge.

The object identified above is achieved according to the following aspects of the present invention.

According to a first aspect of the invention, there is provided (a) a plane polishing machine polishing one surface of a workpiece flat, the workpiece stuck on a bottom surface of a stick-on disk of a circular plate shape being held on and in sliding contact with a polishing surface of a polishing surface plate rotating in one direction, the plane polishing machine comprises (b) a stick-on disk decentering jig of a circular plate shape mounted on the rotating polishing surface plate and having an eccentric aperture formed therethrough into which the stick-on disk is pivotably fitted, (c) a jig rotation drive device having a plurality of guide rollers coming into contact with the stick-on disk decentering jig that is about to move in a circumferential direction together with the polishing surface plate, to thereby prevent the stick-on disk decentering jig from moving circumferentially, the jig rotation drive device rotationally driving the stick-on disk decentering jig so as to revolve, around a pivot center line of the stick-on disk, along a predetermined revolution trajectory via a drive guide roller of the plurality of guide rollers, (d) a rotational direction restriction device permitting rotation of the stick-on disk in a direction identical to a rotational direction of the stick-on disk decentering jig and inhibiting rotation of the stick-on disk in a direction opposite to the rotational direction of the stick-on disk decentering jig, and (e) a jig rotation suppression device periodically suppressing rotation of the stick-on disk decentering jig rotated by the drive guide roller, for a predetermined period.

According to a second aspect of the invention, in the plane polishing machine according to the first aspect of the invention, the rotational direction restriction device imparts a predetermined relative rotational resistance to the stick-on disk decentering jig and the stick-on disk, the rotational direction restriction device, in case that there occurs a relative rotational force exceeding the predetermined relative rotational resistance, permitting rotation of the stick-on disk in the direction identical to the rotational direction of the stick-on disk decentering jig.

According to a third aspect of the invention, in the plane polishing machine according to the first or second aspect of the invention, the rotational direction restriction device comprises serrated teeth formed on an outer circumferential surface of the stick-on disk; and a locking tooth locking one of the serrated teeth in such a manner as to permit rotation of the stick-on disk in the direction identical to the rotational direction of the stick-on disk decentering jig and inhibit rotation of the stick-on disk in the direction opposite to the rotational direction of the stick-on disk decentering jig.

According to a fourth aspect of the invention, in the plane polishing machine according to the third aspect of the invention, the rotational direction restriction device comprises a pressing force regulator changing a pressing force of the locking tooth on the serrated teeth to thereby regulate a rotational resistance of the stick-on disk in the rotational direction of the stick-on disk decentering jig.

According to a fifth aspect of the invention, in the plane polishing machine according to any one of the first through fourth aspects of the invention, the jig rotation suppression device cuts off a rotational force transmission path through which a rotational force is transmitted from the drive guide roller to the stick-on disk decentering jig, only for a predetermined rotational phase period of the jig rotation drive device.

According to a sixth aspect of the invention, in the plane polishing machine according to the fifth aspect of the invention, the jig rotation suppression device interrupts transmission of a driving force between the jig rotation drive device and the stick-on disk decentering jig only for a rotational phase period of the stick-on disk decentering jig during which a pivoting force of the stick-on disk generated by sliding contact with the polishing surface plate indicates a local maximum equal to or greater than a predetermined value in a periodic change attendant on rotation of the stick-on disk decentering jig.

According to a seventh aspect of the invention, in the plane polishing machine according to any one of the first through sixth aspects of the invention, the jig rotation suppression device is a notch formed on an outer circumferential edge of the stick-on disk decentering jig at its site coming into contact with the drive guide roller when there align a rotation center of the polishing surface plate, a rotation center of the stick-on disk decentering jig, and a rotation center of the stick-on disk.

As described above, the plane polishing machine of the first aspect of the invention includes: the circular-plate-shaped stick-on disk decentering jig mounted on the rotating polishing surface plate and having the eccentric aperture formed therethrough into which the stick-on disk is pivotably fitted; the jig rotation drive device having the plurality of guide rollers coming into contact with the stick-on disk decentering jig that is about to move in the circumferential direction together with the polishing surface plate, to thereby prevent the stick-on disk decentering jig from moving circumferentially, the jig rotation drive device 36 rotationally driving the stick-on disk decentering jig so as to revolve, around the pivot center line of the stick-on disk, along the predetermined revolution trajectory via the drive guide roller of the plurality of guide rollers; the rotational direction restriction device permitting rotation of the stick-on disk in the same direction as the rotational direction of the stick-on disk decentering jig and inhibiting rotation of the stick-on disk in the opposite direction to the rotational direction of the stick-on disk decentering jig; and the jig rotation suppression device interrupting the rotational force transmitted from the drive guide roller to the jig rotation drive device only for a predetermined rotational phase period of the jig rotation drive device. This eliminates the need for a pivotal rotation drive device for pivotally rotating the stick-on disk, enabling obtainment of an inexpensive plane polishing machine. At the same time, by virtue of the rotational direction restriction device permitting rotation of the stick-on disk in the same direction as the rotational direction of the stick-on disk decentering jig and inhibiting rotation of the stick-on disk in the opposite direction opposite to the rotational direction of the stick-on disk decentering jig, and by virtue of the jig rotation suppression device temporarily interrupting the rotational force transmitted from the drive guide roller to the stick-on disk decentering jig only for a predetermined rotational phase period of the stick-on disk decentering jig, the pivoting period and the revolution period of the stick-on disk are desynchronized so that those periods are out of synchronization, enabling the polished surface to have a high flatness.

According to the plane polishing machine of the second aspect of the invention, the rotational direction restriction device imparts a predetermined relative rotational resistance to the stick-on disk decentering jig and the stick-on disk, and if there occurs a relative rotational force exceeding the predetermined relative rotational resistance, permits rotation of the stick-on disk in the same direction as the rotational direction of the stick-on disk decentering jig, whereupon the stick-on disk can rotate stably in the same direction as the rotational direction of the stick-on disk decentering jig.

According to the plane polishing machine of the third aspect of the invention, the rotational direction restriction device includes: the serrated teeth formed on the outer circumferential surface of the stick-on disk; and the locking tooth locking one of the serrated teeth in such a manner as to permit rotation of the stick-on disk in the same direction as the rotational direction of the stick-on disk decentering jig and inhibit rotation of the stick-on disk in the opposite direction to the rotational direction of the stick-on disk decentering jig. This allows the simple mechanism to permit rotation of the stick-on disk in the same direction as the rotational direction of the stick-on disk decentering jig.

According to the plane polishing machine of the fourth aspect of the invention, the rotational direction restriction device includes: the pressing force regulator that changes the pressing force of the locking tooth on the serrated teeth to thereby regulate the rotational resistance of the stick-on disk in the rotational direction of the stick-on disk decentering jig. This restricts excess rotation of the stick-on disk in the same direction as the rotational direction of the stick-on disk decentering jig, achieving stable rotation of the stick-on disk.

According to the plane polishing machine of the fifth aspect of the invention, the jig rotation suppression device interrupts the transmission path of a driving force from the drive guide roller to the stick-on disk decentering jig only for a predetermined rotational phase period of the stick-on disk decentering jig. This allows rotation of the jig rotation drive device to be temporarily interrupted, permitting advance in the rotational phase of the stick-on disk, so that the pivoting period and the revolution period of the stick-on disk are securely desynchronized.

According to the plane polishing machine of the sixth aspect of the invention, the jig rotation suppression device interrupts the transmission of driving force between the jig rotation drive device and the stick-on disk decentering jig to temporarily suppress the rotation drive of the stick-on disk decentering jig by the jig rotation drive device only for a rotational phase period of the stick-on disk decentering jig during which rotational force of the stick-on disk generated by sliding contact with the polishing surface plate indicates a local maximum equal to or greater than a predetermined value in a periodic change attendant on rotation of the stick-on disk decentering jig. This temporarily interrupts the rotational force transmitted from the jig rotation device only for a predetermined rotational phase period of the stick-on disk decentering jig, permitting advance in the rotational phase of the stick-on disk, so that the pivoting period and the revolution period of the stick-on disk are securely desynchronized.

According to the plane polishing machine of the seventh aspect of the invention, the jig rotation suppression device includes the notch formed on the outer circumferential edge of the stick-on disk decentering jig at its site coming into contact with the drive guide roller when the rotation center line of the polishing surface plate, the revolution center line of the stick-on disk decentering jig, and the pivot center line of the stick-on disk are located on the straight line. This allows the simple mechanism to desynchronize the pivoting period and the revolution period of the stick-on disk so that those periods are out of synchronization.

FIG. 1 conceptually shows a principal part of a plane polishing machine that is an example of the present invention.

Figure 2:
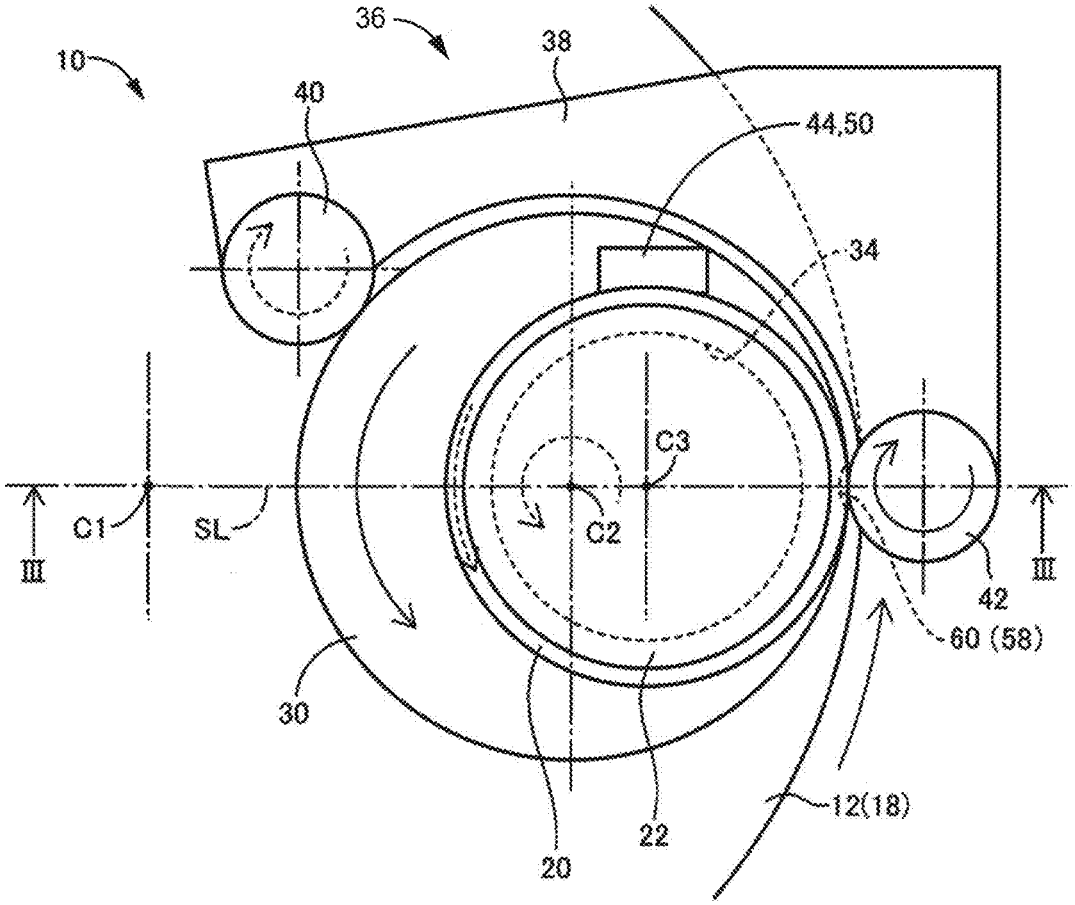
FIG. 2 is a conceptual plan view showing a stick-on disk, a stick-on disk decentering jig, a jig rotation drive device, a rotational direction restriction device, and a jig rotation suppression device, respectively mounted on the plane polishing machine of FIG. 1.
Figure 6:
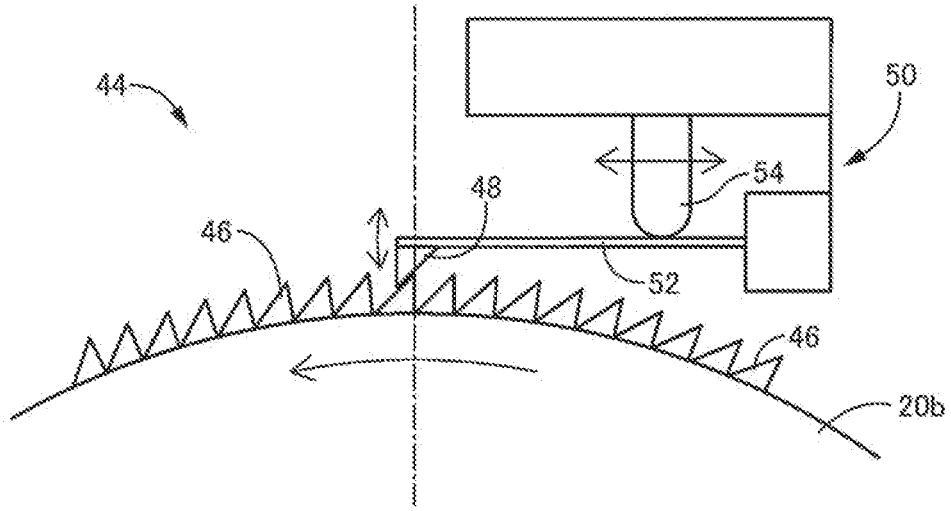

FIG. 6 schematically shows the rotational direction restriction device shown in FIG. 2.

Figure 3:
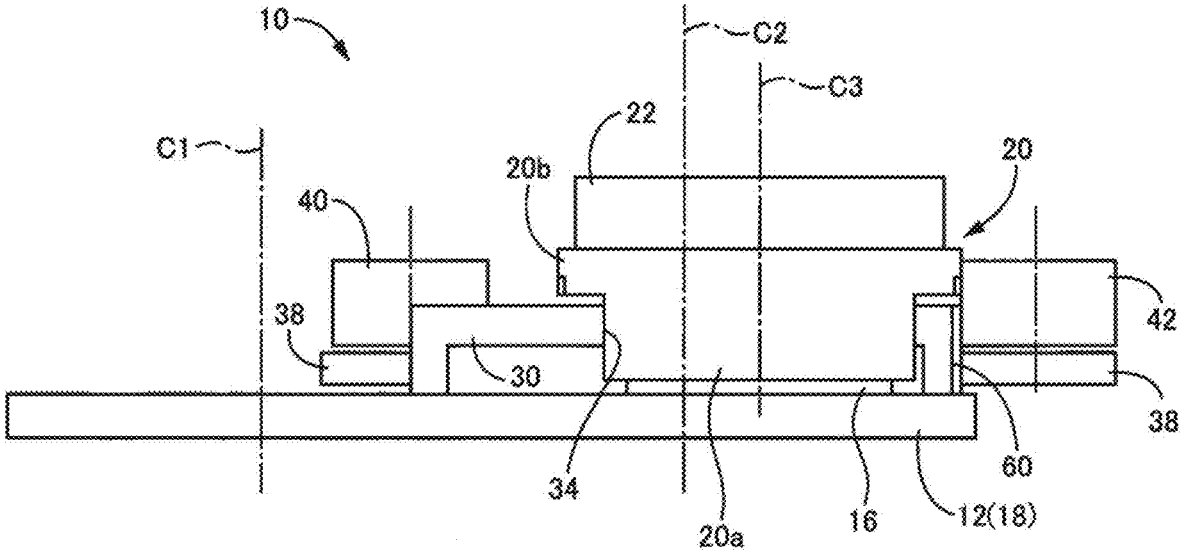
FIG. 3 is a conceptual sectional view taken along line III-III of FIG. 2.
Figure 7:
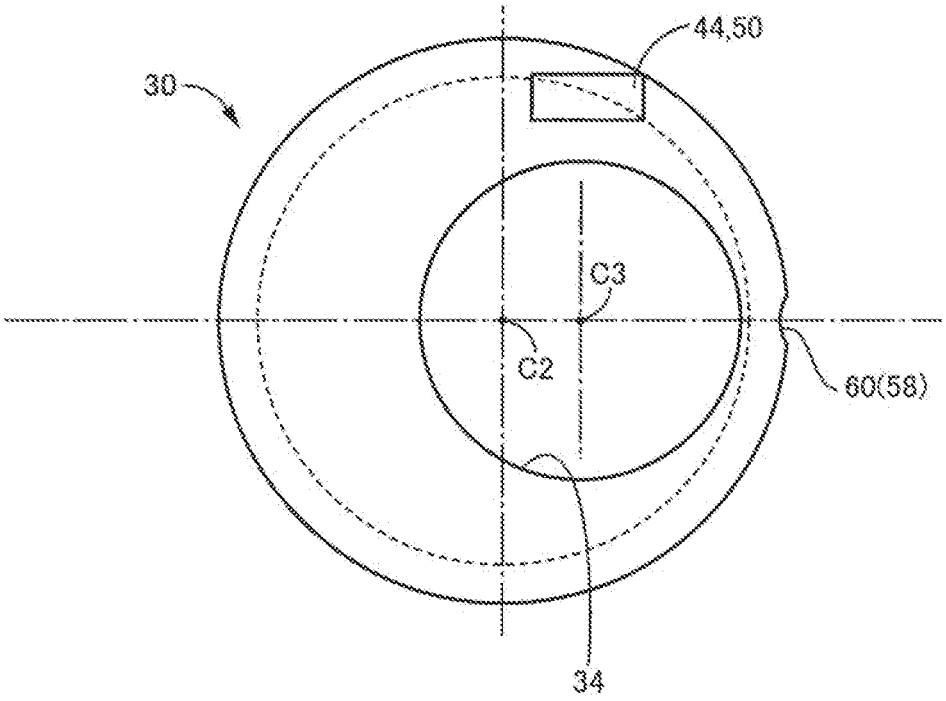

FIG. 7 conceptually shows a plan view of the stick-on disk decentering Jig in FIGS. 2 and 3.

Figure 8:
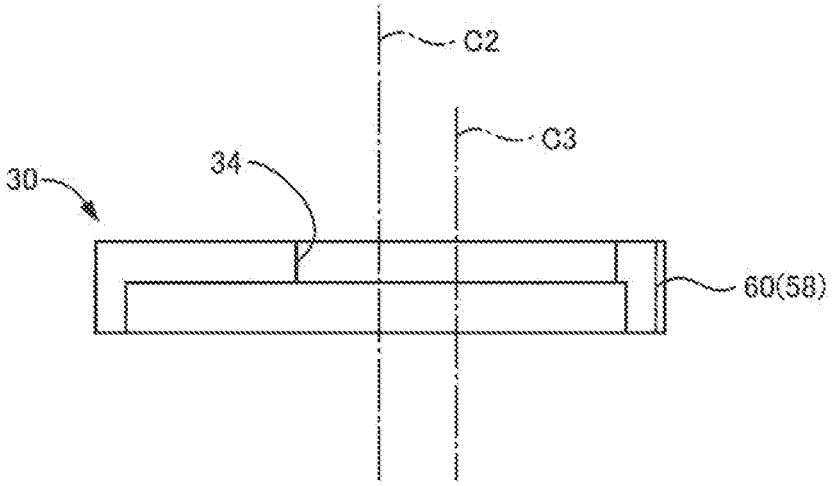

FIG. 8 conceptually shows a sectional view of the stick-on disk decentering jig shown in FIGS. 2 and 3.

Figure 9:
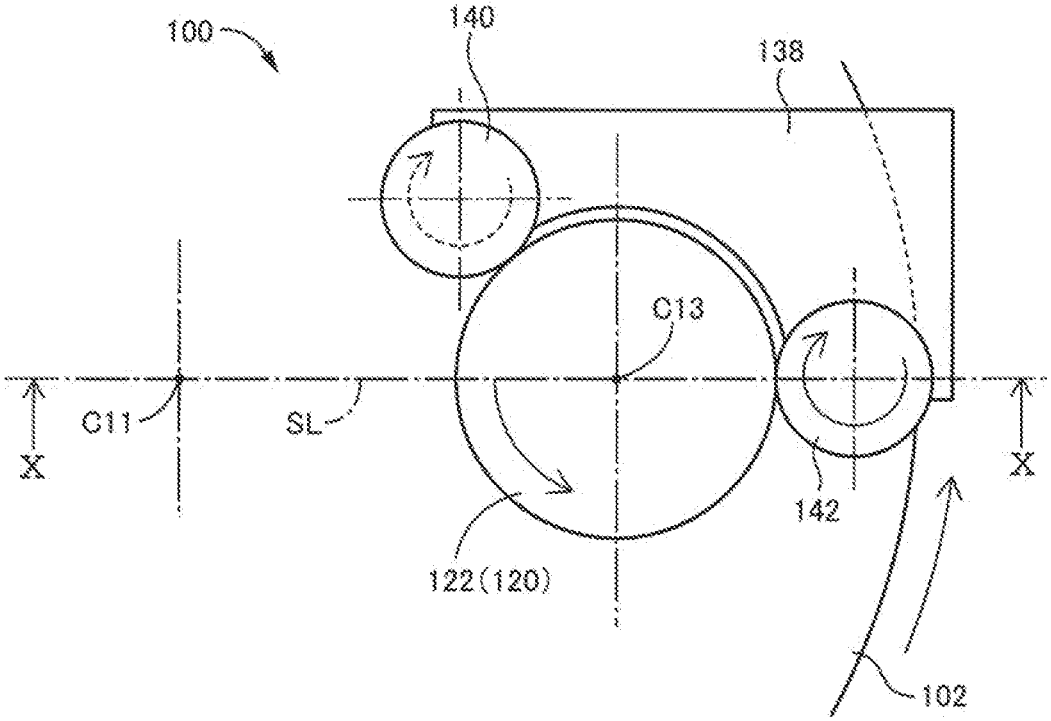

FIG. 9 is a plan view showing the stick-on a disk and the jig rotation drive device, respectively, which is mounted on a conventional plane polishing machine of the stick-on disk does not revolve. This figure corresponds to FIG. 2.

Figure 10:
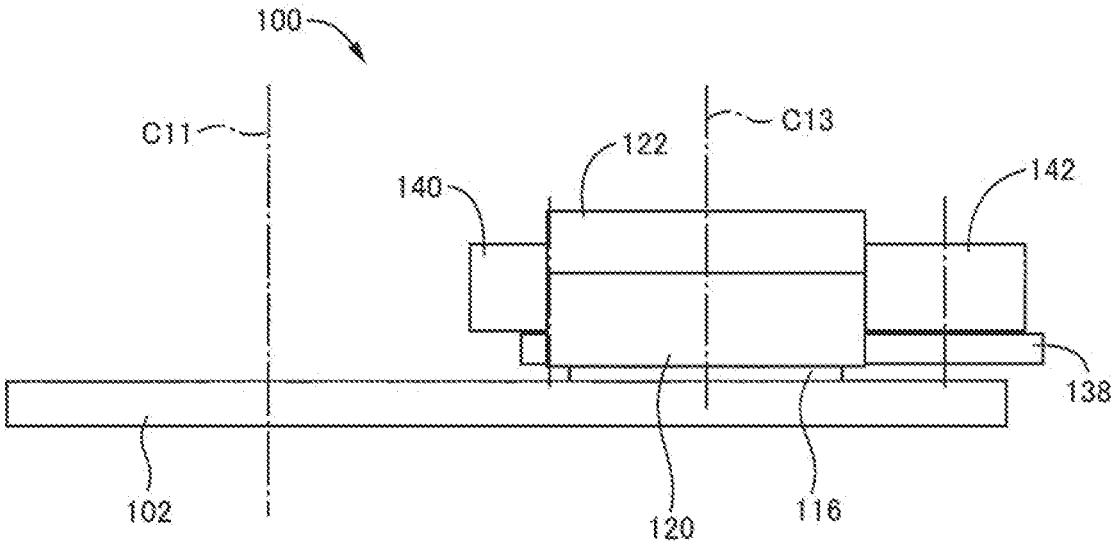

FIG. 10 conceptually shows a sectional view of the stick-on disk taken along line X-X of FIG. 9. This figure corresponds to FIG. 3.

FIG. 11 is a table showing PV values of workpiece surfaces polished respectively in the polishing tests by the inventor.

FIG. 12 is a section profiles of workpiece surfaces polished respectively in the polishing tests by the inventor.

Figure 13:
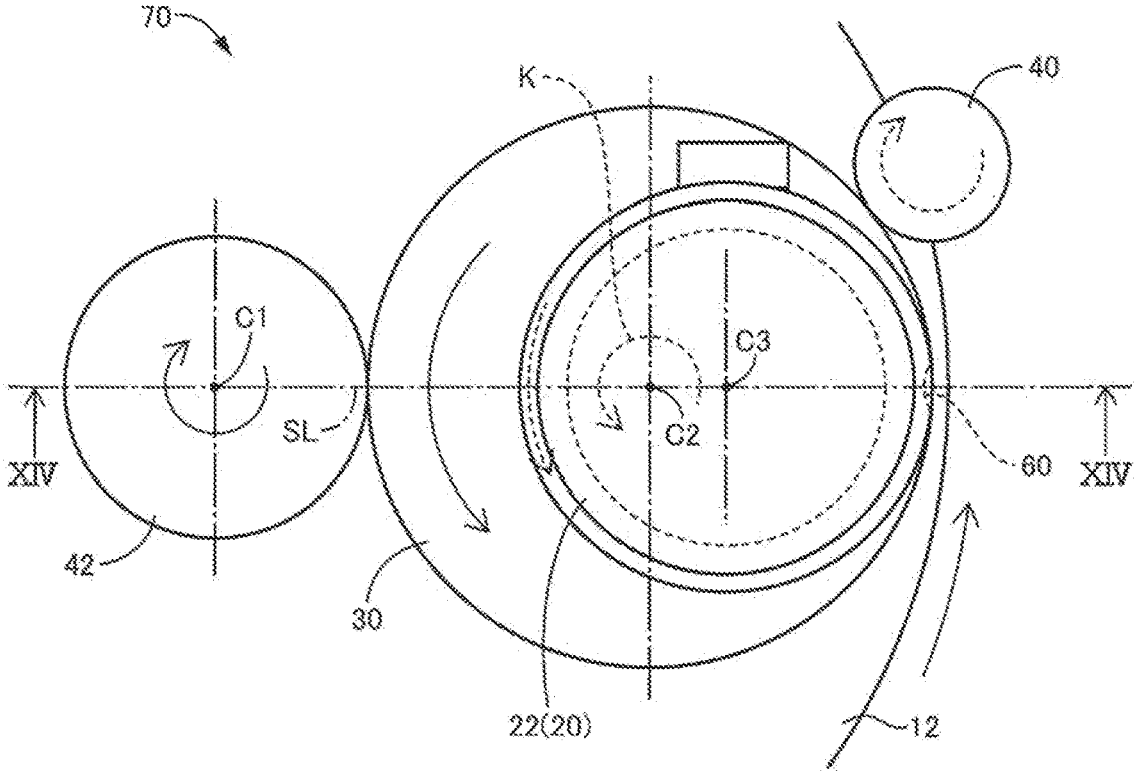

FIG. 13 is a plan view of another embodiment of the present invention This figure corresponds to FIG. 2.

Figure 14:
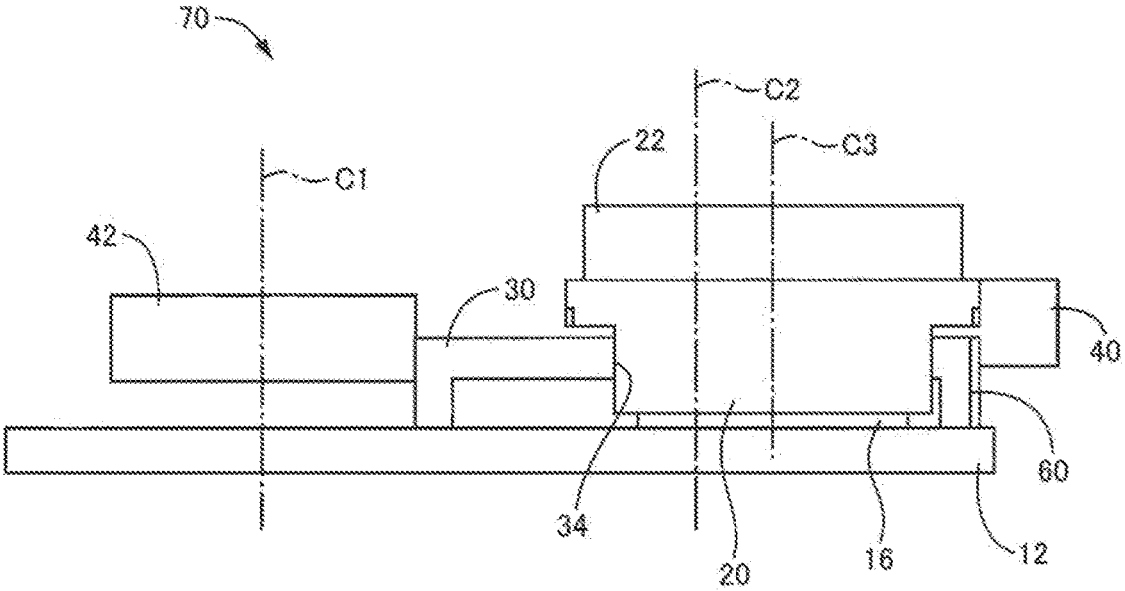

FIG. 14 is a conceptual sectional view taken along line XIII-XIII of FIG. 13.

DESCRIPTION OF THE PREFERRED EMBODIMENTS

Examples of application of the present invention will now be described in detail with Reference to the Accompanying Drawings.

First Embodiment

Figure 1:
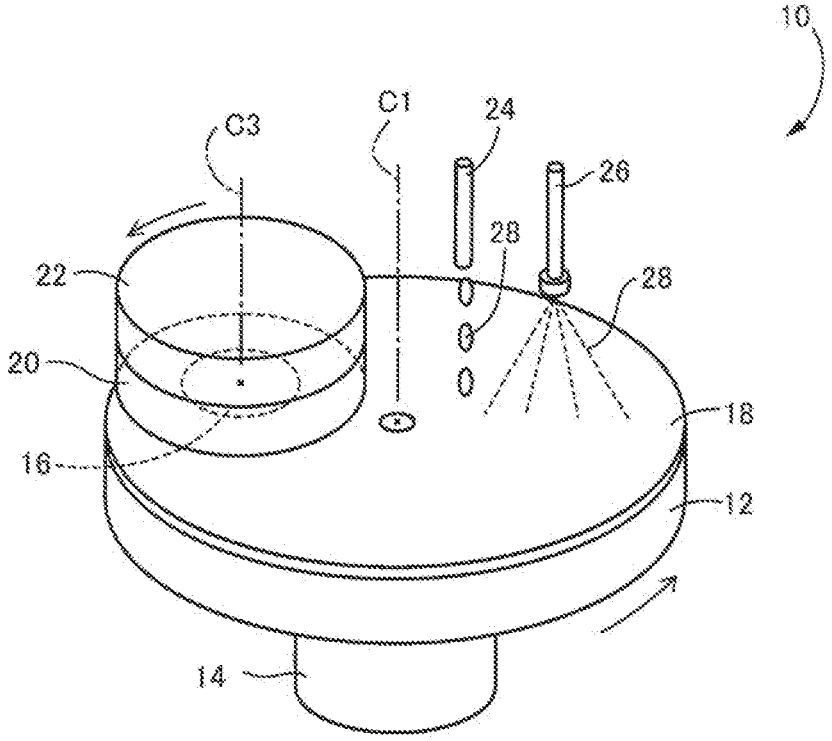

FIG. 1 conceptually shows a principal part of a plane polishing machine 10 that is an example of the present invention. Referring to FIG. 1, the plane polishing machine 10 includes a polishing surface plate 12 supported rotatably around a vertically extending rotation center line C1, the polishing surface plate 12 being rotationally driven by a surface plate drive motor 14 e.g. in one rotational direction indicated by an arrow of FIG. 1. The polishing surface plate 12 has a top surface to which is attached a sheet-like, preferably polishing-abrasive-grain containing type polishing pad 18 with a diameter identical to that of the polishing surface plate 12. In this embodiment, the polishing pad 18 has a top surface that serves as a smoothing polishing surface against which is pressed a workpiece 16 such as a semiconductor substrate.

The polishing surface plate 12 has, at a position eccentric from the rotation center line C1, a stick-on disk 20 having a bottom surface to which the workpiece 16 is attached by sticking or adhesion or by using a holding frame or the like, the stick-on disk 20 being arranged held pivotally around a pivot center line C3 parallel to the rotation center line C1 and displaceably in the direction of the pivot axis C3. A weight 22 is placed on the stick-on disk 20 to increase the surface pressure of the workpiece 16 during polishing. The stick-on disk 20 pivots in a pivotal direction indicated by another arrow of FIG. 1, by a rotation moment that is generated based on the difference in friction force received from the polishing pad 18 between the inner and outer tangential sides of the polishing surface plate 12.

The plane polishing machine 10 includes a drip nozzle 24 and a spray nozzle 26 disposed in the vicinity of the stick-on disk 20 so that the polishing surface plate 12 is supplied thereon with polishing liquid (lubricant) 28 that is e.g. oxidizing or alkaline aqueous solution discharged from a tank not shown.

The plane polishing machine 10 includes, as needed: an adjustment tool holding member not shown arranged rotatably around a rotation axis parallel to the rotation axis C1 of the polishing surface plate 12 and displaceably in the direction of the rotation axis and in the radial direction of the polishing surface plate 12; and a polishing body adjustment tool (dresser or conditioner) like a diamond wheel not shown attached to a bottom surface, facing the polishing pad 14, of the adjustment tool holding member. The adjustment tool holding member and the polishing body adjustment tool attached thereto are pressed against the polishing pad 18 and reciprocated in the radial direction of the polishing surface plate 12 while being rotationally driven by an adjustment tool drive motor not shown, whereby a polishing surface of the polishing pad 18 is adjusted so that the surface condition of the polishing pad 18 is kept at all times in a state suitable for polishing.

FIGS. 2 and 3 show, though not shown in FIG. 1: a stick-on disk decentering jig 30 mounted on the polishing surface plate 12; a jig rotation drive device 36 fixed to the plane polishing machine 10 to rotationally drive the stick-on disk decentering jig 30 around a revolution center line C2 parallel to the rotation center line C1; a rotational direction restriction device 44 restricting the rotational direction of the stick-on disk 20 relative to the stick-on disk decentering jig 30 to one direction; and a jig rotation suppression device 58 desynchronizing the rotation of the stick-on disk 20 relative to the rotation of stick-on disk decentering jig 30. FIG. 2 is a plan view and FIG. 3 is a sectional view taken along line III-III of FIG. 2.

Figure 4:
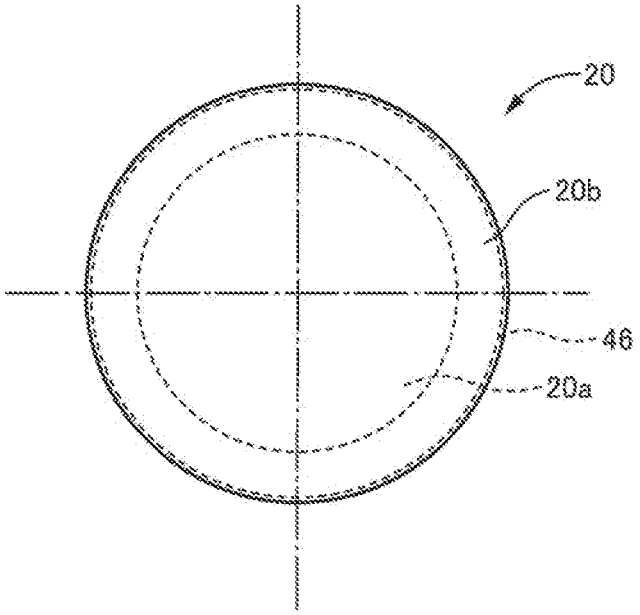
FIG. 4 is a conceptual plan view of the stick-on disk shown in FIG. 2 and FIG. 3.
Figure 5:
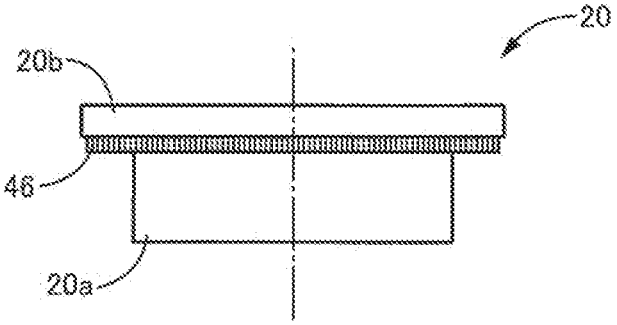
FIG. 5 is a conceptual sectional view of the stick-on disk shown in FIGS. 2 and FIG.

FIG. 4 is a plan view of the stick-on disk 20 and FIG. 5 is a side view of the stick-on disk 20. The stick-on disk 20 includes integrally: a shortened cylindrical body portion 20*a* to which the workpiece 16 is fixed on the bottom surface; and a flange portion 20*b* protruding from the body portion 20*a* at its upper end toward the outer peripheral side, the flange portion 20*b* being larger in diameter than the body portion 20*a*. The flange portion 20*b* has, on its outer circumferential surface, circumferentially continuously formed serrated teeth 46.

The stick-on disk decentering jig 30 is in the shape of a circular plate whose rotation center line is the revolution center line C2, and has an eccentric aperture 34 centered at a position eccentric by a predetermined eccentric distance r from the revolution center line C2, the eccentric aperture 34 being formed to receive the body portion 20*a* of the stick-on disk 20 relative-rotatably and displaceably in the thickness direction. The eccentric aperture 34 has a center line substantially identical to the pivot center line C3 of the stick-on disk 20. For example, the eccentric aperture 34 has a diameter greater than the radius of the stick-on disk decentering jig 30, with the predetermined eccentric distance r being equal to or less than about one-half the radius of the eccentric aperture 34.

The jig rotation drive device 36 includes: a guide roller fixing base 38 secured to a frame not shown of the polishing machine 10; and an idle guide roller 40 and a drive guide roller 42 in a pair that are disposed on the guide roller fixing base 38. The jig rotation drive device 36 comes into contact with the stick-on disk decentering jig 30 that is mounted on the polishing surface plate 12 and that is about to move in the circumferential direction together with the polishing surface plate 12, to thereby prevent the stick-on disk decentering jig 30 from moving circumferentially and keep stationary the revolution center line C2 that is the rotation center line of the stick-on disk decentering jig 30, and rotationally drives the stick-on disk decentering jig 30 around the revolution center line C2 e.g. at a certain speed via the drive guide roller 42. When the stick-on disk decentering jig 30 is rotated around the revolution center line C72, the pivot center line C3 of the stick-on disk 20 is displaced within the eccentric aperture 34 along a revolution trajectory K whose diameter is smaller than the radius of the eccentric aperture 34, so that the stick-on disk 20 is revolved around the revolution center line C2 while pivoting around the pivot center line C3.

The idle guide roller 40 is disposed freely rotatably on the guide roller fixing base 38, while the drive guide roller 42 is disposed on the guide roller fixing base 38 so as to be capable of being rotationally driven in one direction by a drive motor not shown. The drive guide roller 42 is disposed on the guide roller fixing base 38 such that its rotation center lies on a straight line SL joining the rotation center line C1 of the polishing surface plate 12 and the revolution center line C2 that is the rotation center line of the stick-on disk decentering jig 30. The idle guide roller 40 is disposed on the guide roller fixing base 38 such that the idle guide roller 40 comes into contact with the stick-on disk decentering jig 30 at its site on the downstream side, in the rotational direction of the polishing surface plate 12, with respect to the straight line SL joining the rotation center line C1 of the polishing surface plate 12 and the revolution center line C2 that is the rotation center line of the stick-on disk decentering jig 30, the site lying on the inner side of an arc, around the rotation center line C1, passing through the revolution center line C2 that is the rotation center line of the stick-on disk decentering jig 30.

The rotational direction restriction device 44 includes, as shown in a schematic view of FIG. 6: the serrated teeth 46 formed continuously on the outer circumferential surface of the flange portion 20*b* of the stick-on disk 20; and a locking tooth 48 disposed on the stick-on disk decentering jig 30 to lock one of the serrated teeth 46. The rotational direction restriction device 44 permits rotation of the stick-on disk 20 in the same direction as the rotational direction of the stick-on disk decentering jig 30 and inhibits rotation of the stick-on disk 20 in the opposite direction to the rotational direction of the stick-on disk decentering jig 30. The rotational direction restriction device 44 imparts a predetermined relative rotational resistance to the stick-on disk decentering jig 30 and the stick-on disk 20 and, in case that there occurs a relative rotational force exceeding the predetermined relative rotational resistance, permits rotation of the stick-on disk 20 in the same direction as the rotational direction of the stick-on disk decentering jig 30.

The rotational direction restriction device 44 includes a pressing force regulator 50 that changes the pressing force of the locking tooth 48 on the serrated teeth 46 to thereby regulate the rotational resistance of the stick-on disk 20 in the rotational direction of the stick-on disk decentering jig 30. The locking tooth 48 is disposed at a tip of a leaf spring 52 whose base end is secured to the stick-on disk decentering jig 30. The pressing force regulator 50 includes an abutment member support device 56 that supports an abutment member 54 abutting against a back surface of the leaf spring 52, in such a manner as to be displaceable in the longitudinal direction of the leaf spring 52. To the extent that the abutment member 54 can be displaced toward the tip side of the leaf spring 52, the pressing force of the locking tooth 48 against the serrated teeth 46 is increased, so that the rotational resistance rises.

The jig rotation suppression device 58 shuts off the rotational force transmitted from the jig rotation drive device 36 to the stick-on disk decentering jig 30 only for a predetermined rotational phase period of the stick-on disk decentering jig 30 to suppress rotation of the stick-on disk decentering jig 30 so that rotation of the stick-on disk 20 is out of synchronization with rotation of the stick-on disk decentering jig 30, thereby allowing rotation of the stick-on disk 20 to advance by a predetermined amount with respect to rotation of the stick-on disk decentering jig 30. The jig rotation suppression device 58 interrupts the transmission of driving force between the jig rotation drive device 36 and the stick-on disk decentering jig 30 to temporarily suppress the rotation drive of the stick-on disk decentering jig 30 by the jig rotation drive device 36 only for a rotational phase period of the stick-on disk decentering jig 30 during which rotational force of the stick-on disk 20 generated by sliding contact with the polishing surface plate 12 indicates a local maximum equal to or greater than a predetermined value in a periodic change attendant on rotation of the stick-on disk decentering jig 30. Preferably, as seen in the stick-on disk decentering jig 30 of FIGS. 7 and 8, the jig rotation suppression device 58 includes a notch 60 formed on an outer circumferential edge of the stick-on disk decentering jig 30 at its site coming into contact with the drive guide roller 42 when there align the rotation center line C1 of the polishing surface plate 12, the revolution center line C2 that is the rotation center line of the stick-on disk decentering jig 30, and the pivot center line C3 of the stick-on disk 20.

Since the stick-on disk 20 amounted on the polishing surface plate 12 in sliding contact with the polishing surface plate 12 is subjected to a greater friction force from the outer peripheral side than from the inner peripheral side of the polishing surface plate 12, the stick-on disk 20 is pivoted in the same rotational direction as that of the stick-on disk decentering jig 30, as shown in FIG. 2. The rotational force causing the stick-on disk 20 to pivot increases or decreases in relation to the rotational phase of the stick-on disk decentering jig 30 and is maximized when there lie in a line the rotation center line C1 of the polishing surface plate 12, the revolution center line C2 that is the rotation center line of the stick-on disk decentering jig 30, and the pivot center line C3 of the stick-on disk 20.

EXPERIMENTAL EXAMPLES

Experimental examples carried out by the inventor will hereinafter be described. Under loose abrasive polishing conditions which follow, a common sample object to be polished was subjected to: two types of polishing tests (Comparative-example tests 1 and 2) that use a plane polishing machine not using the stick-on disk decentering jig 30, shown in FIGS. 9 and 10; and two types of polishing tests (Example tests 1 and 2) that use a plane polishing machine including the rotational direction restriction device 44 and the jig rotation suppression device 58, similar to the polishing machine 10 shown in FIGS. 2 to 8. In Comparative-example test 1 and Example test 1, a 5 mm-thick foamed polyurethane pad was used as a polishing pad, and a 5 wt % ceria slurry was used as a polishing solution. In Comparative-example test 2 and Example test 2, a 5 mm-thick semi-fixed abrasive pad was used as the polishing pad, and water was used as the polishing solution. The semi-fixed abrasive pad is a polishing-abrasive-grain containing type polishing pad made of epoxy resin or PES resin having closed pores or open pores that contain polishing abrasive grains (ceria).

[Polishing Test Conditions]

- Plane polishing machine: Lapmaster LP15 modified machine
- Workpiece: Synthetic quartz wafer (65 mmΦ)
- Workpiece rotation speed: 60 rpm
- Polishing pad/polishing solution: Foamed polyurethane pad/Ceria slurry (5 wt %)
- Polishing pad/Polishing solution: Abrasive-grain (ceria) containing pad/Water
- Polishing pad diameter: 300 mmΦ
- Polishing pad rotation speed: 60 rpm
- Polishing pressure: 20 kPa
- Center-to-center distance between polishing pad and workpiece: 85 mm
- Center-to-center distance between polishing pad and revolution trajectory: 85 mm
- Center-to-center distance between revolution trajectory and workpiece: 40 mm
- Polishing solution flowrate: 10 ml/min
- Dresser pressure/Dresser rotation speed/Dressing time: 25 kPa/60 rpm/120 sec FIG. 11 is a table showing PV values of workpiece surfaces that were polished in Comparison-example tests 1 and 2 and Example tests 1 and 2. The PV value is a difference (μm) between a highest position (peak) and a lowest position (valley) on the workpiece surface, measured using a laser interferometer. FIG. 12 shows section profiles of workpieces polished respectively in the Comparison-example tests 1 and 2 and Example tests 1 and 2. The section profiles were measured using the laser interferometer.

In FIG. 11, the workpiece polished in Example test 1 has a P value significantly smaller than that of the workpiece polished in Comparison-example test 1. The workpiece polished in Example test 2 has a PV value significantly smaller than that of the workpiece polished in Comparison-example test 2. In FIG. 12, the section profile of the workpiece polished in Example test 1 has a flatness significantly higher than that of the workpiece polished in Comparison-example test 1. The section profile of the workpiece polished in Example test 2 has a flatness significantly higher than that of the workpiece polished in Comparison-example test 2. Such facts reveal that, even if using the same polishing pad and the same polishing solution, in case that the workpiece is pivoted and revolved with pivoting and revolution being desynchronized, the workpiece can have a significantly higher flatness on its polished surface, as compared with the case where the workpiece is only pivoted. When pivoting and revolution of the workpiece are desynchronized, shape transfer is suppressed, so that the workpiece PV value diminishes to a large extent, resulting in the workpiece section profile with a significantly high flatness. The shape transfer refers to transfer to the workpiece polished surface, of a shape formed due to wear at a portion against which the workpiece is pressed on the top surface of the polishing pad.

In FIG. 11, the workpiece polished in Comparison-example test 2 has a P value significantly smaller than that of the workpiece polished in Comparison-example test 1. The workpiece polished in Example test 2 has a PV value significantly smaller than that of the workpiece polished in Example test 1. In FIG. 12, the section profile of the workpiece polished in Comparison-example test 2 has a flatness significantly higher than that of the workpiece polished in Comparison-example test 1. The section profile of the workpiece polished in Example test 2 has a flatness significantly higher than that of the workpiece polished in Example test 1. Such facts reveal that, in spite of the same polishing rotation actions, fixed abrasive polishing using the semi-fixed abrasive pad as the polishing pad and using water as the polishing solution gives a higher flatness to the polished workpiece surface, as compared with loose abrasive polishing using the foamed polyurethane pad as the polishing pad and using a ceria slurry as the polishing solution.

As described above, the plane polishing machine 10 of this embodiment includes: the circular-plate-shaped stick-on disk decentering jig 30 mounted on the rotating polishing surface plate 12 and having the eccentric aperture 34 formed therethrough into which the stick-on disk 20 is pivotably fitted; the jig rotation drive device 36 having the plurality of guide rollers (40 and 42) coming into contact with the stick-on disk decentering jig 30 that is about to move in the circumferential direction together with the polishing surface plate 12, to thereby prevent the stick-on disk decentering jig 30 from moving circumferentially, the jig rotation drive device 36 rotationally driving the stick-on disk decentering jig 30 so as to revolve, around the pivot center line C3 of the stick-on disk 20, along the predetermined revolution trajectory K via the drive guide roller 42 of the plurality of guide rollers; the rotational direction restriction device 44 permitting rotation of the stick-on disk 20 in the same direction as the rotational direction of the stick-on disk decentering jig 30 and inhibiting rotation of the stick-on disk 20 in the opposite direction to the rotational direction of the stick-on disk decentering jig 30; and the jig rotation suppression device 58 interrupting the rotational force transmitted from the drive guide roller 42 to the jig rotation drive device 36 only for a predetermined rotational phase period of the jig rotation drive device 36. This eliminates the need for a pivotal rotation drive device for pivotally rotating the stick-on disk 20, enabling obtainment of an inexpensive plane polishing machine 10. At the same time, by virtue of the rotational direction restriction device 44 permitting rotation of the stick-on disk 20 in the same direction as the rotational direction of the stick-on disk decentering jig 30 and inhibiting rotation of the stick-on disk 20 in the opposite direction opposite to the rotational direction of the stick-on disk decentering jig 30, and by virtue of the jig rotation suppression device 58 temporarily interrupting the rotational force transmitted from the drive guide roller 42 to the stick-on disk decentering jig 30 only for a predetermined rotational phase period of the stick-on disk decentering jig 30, the pivoting period and the revolution period of the stick-on disk 20 are desynchronized, so that those periods are out of synchronization, enabling the polished surface to have a high flatness.

According to the plane polishing machine 10 of this embodiment, the rotational direction restriction device 44 imparts a predetermined relative rotational resistance to the stick-on disk decentering jig 30 and the stick-on disk 20, and if there occurs a relative rotational force exceeding the predetermined relative rotational resistance, permits rotation of the stick-on disk 20 in the same direction as the rotational direction of the stick-on disk decentering jig 30, whereupon the stick-on disk 20 can rotate stably in the same direction as the rotational direction of the stick-on disk decentering jig 30.

According to the plane polishing machine 10 of this embodiment, the rotational direction restriction device 44 includes: the serrated teeth 46 formed on the outer circumferential surface of the stick-on disk 20; and the locking tooth 48 locking one of the serrated teeth 46 in such a manner as to permit rotation of the stick-on disk 20 in the same direction as the rotational direction of the stick-on disk decentering jig 30 and inhibit rotation of the stick-on disk 20 in the opposite direction to the rotational direction of the stick-on disk decentering jig 30. This allows the simple mechanism to permit rotation of the stick-on disk 2.0 in the same direction as the rotational direction of the stick-on disk decentering jig 30.

According to the plane polishing machine 10 of this embodiment, the rotational direction restriction device 44 includes: the pressing force regulator 50 that changes the pressing force of the locking tooth 48 on the serrated teeth 46 to thereby regulate the rotational resistance of the stick-on disk 20 in the rotational direction of the stick-on disk decentering jig 30. This restricts excess rotation of the stick-on disk 20 in the same direction as the rotational direction of the stick-on disk decentering jig 30, achieving stable rotation of the stick-on disk 20.

According to the plane polishing machine 10 of this embodiment, the jig rotation suppression device 58 interrupts the transmission of a driving force between the jig rotation drive device 36 and the stick-on disk decentering jig 30 only for a rotational phase period of the stick-on disk decentering jig 30 during which pivoting force of the stick-on disk 20 generated by sliding contact with the polishing surface plate 12 indicates a local maximum equal to or greater than a predetermined value in a periodic change attendant on rotation of the stick-on disk decentering jig 30. This allows the rotational force from the jig rotation drive device 36 to be temporarily interrupted only for the rotational phase period of the stick-on disk decentering jig 30 during which the stick-on disk 20 has an increased pivoting force, to permit advance in the rotational phase of the stick-on disk 20, so that the pivoting period and the revolution period of the stick-on disk 20 are securely desynchronized.

According to the plane polishing machine 10 of this embodiment, the jig rotation suppression device 58 includes the notch 60 formed on the outer circumferential edge of the stick-on disk decentering jig 30 at its site coming into contact with the drive guide roller 42 when the rotation center line C1 of the polishing surface plate 12, the revolution center line C2 of the stick-on disk decentering jig 30, and the pivot center line (3 of the stick-on disk 20 are located on the straight line SL in plan view. This allows the simple mechanism to desynchronize the pivoting period and the revolution period of the stick-on disk 20, so that those periods are out of synchronization.

Second Embodiment

Another embodiment of the present invention will then be described. In the following description, portions common to the first embodiment are designated by the same reference numerals and will not again be described.

FIGS. 13 and 14 are respectively a plan view of another embodiment of the present invention and a sectional view thereof taken along line XIV-XIV of FIG. 13, which correspond respectively to FIGS. 2 and 3 described above.

This embodiment is configured similar to the first embodiment except that the positions differ of the idle guide roller 40 and the drive guide roller 42 of the jig rotation drive device 36 that rotationally drives the stick-on disk decentering jig 30 around the revolution center line C2 parallel to the rotation center line C1.

The drive guide roller 42 of this embodiment is disposed rotatably around the center line identical to the rotation center line C1 of the polishing surface plate 12. The idle guide roller 40 is disposed on the guide roller fixing base 38 such that the idle guide roller 40 comes into contact with the stick-on disk decentering jig 30 at its site on the downstream side, in the rotational direction of the polishing surface plate 12, with respect to the straight line SL joining the rotation center line C1 of the polishing surface plate 12 and the revolution center line C2 that is the rotation center line of the stick-on disk decentering jig 30, the site lying on the outer side of the arc, around the rotation center line C1, passing through the revolution center line C2 that is the rotation center line of the stick-on disk decentering jig 30.

Similar to the jig rotation drive device 36 of the first embodiment, in this embodiment as well, the jig rotation drive device 36 comes into contact with the stick-on disk decentering jig 30 that is mounted on the polishing surface plate 12 and that is about to move in the circumferential direction together with the polishing surface plate 12, to thereby prevent the stick-on disk decentering jig 30 from moving circumferentially and keep stationary the revolution center line C2 that is the rotation center line of the stick-on disk decentering jig 30, and rotationally drives the stick-on disk decentering jig 30 around the revolution center line C2 e.g. at a certain speed via the drive guide roller 42. Since the stick-on disk decentering jig 30 is rotated around the revolution center line C2, effect similar to that of the first embodiment can be obtained.

Although the embodiments of the present invention have hereinabove been set forth, the present invention is applicable to other modes.

Although for example, the jig rotation drive device 36 of the above embodiments includes the idle guide roller 40 and the drive guide roller 42 in a pair, it may include other guide rollers or may include a plurality of drive guide rollers.

Although the rotational direction restriction device 44 of the above embodiments includes the serrated teeth 46 formed on the outer circumferential surface of the flange portion 20*b* of the stick-on disk 20 and the locking tooth 48 disposed on the stick-on disk decentering jig 30 so as to be capable of locking one of the serrated teeth 46, the serrated teeth 46 may be formed on the inner circumferential surface of the eccentric aperture 34 of the stick-on disk decentering jig 30, while the stick-on disk 20 may have the locking tooth 48 locking one of the serrated teeth 46 on the inner circumferential surface of the eccentric aperture 34.

The jig rotation suppression device 58 of the above embodiments may desynchronize the pivoting period and the revolution period of the stick-on disk 20 by suppressing the rotation transmitted from the drive guide roller 42 to the stick-on disk decentering jig 30, through control of an electric motor that rotationally drives the drive guide roller 42.

Although not exemplified one by one, the present invention can variously be modified without departing from the spirit of the present invention.

EXPLANATIONS OF LETTERS OR NUMERALS

10: plane polishing machine
12: polishing surface plate
16: workpiece
20: stick-on disk
30: stick-on disk decentering jig
34: eccentric aperture
36: jig rotation drive device
42: drive guide roller
44: rotational direction restriction device
46: serrated teeth
48: locking tooth
58: jig rotation suppression device
60: notch
C1: rotation center line
C2: revolution center line
C3: pivot center line

What is claimed is:

1. A plane polishing machine polishing one surface of a workpiece flat, the workpiece stuck on a bottom surface of a stick-on disk of a circular plate shape being held on and in sliding contact with a polishing surface of a polishing surface plate rotating in one direction, the plane polishing machine comprising:

a stick-on disk decentering jig of a circular plate shape mounted on the polishing surface plate and having an eccentric aperture formed therethrough into which the stick-on disk is pivotably fitted;

a jig rotation drive device having a plurality of guide rollers coming into contact with the stick-on disk decentering jig that prevents the stick-on disk decentering jig from moving in a circumferential direction together with the polishing surface plate, the jig rotation drive device rotationally driving the stick-on disk decentering jig so as to revolve, around a pivot center line of the stick-on disk, along a predetermined revolution trajectory via a drive guide roller of the plurality of guide rollers;

a rotational direction restriction device permitting rotation of the stick-on disk in a direction identical to a rotational direction of the stick-on disk decentering jig and inhibiting rotation of the stick-on disk in a direction opposite to the rotational direction of the stick-on disk decentering jig; and a jig rotation suppression device periodically suppressing rotation of the stick-on disk decentering jig rotated by the drive guide roller, for a predetermined period.

2. The plane polishing machine of claim 1, wherein if a relative rotational force exceeding the predetermined relative rotational resistance occurs, the rotational direction restriction device permits rotation of the stick-on disk in the direction identical to the rotational direction of the stick-on disk decentering jig.

3. The plane polishing machine of claim 1, wherein the rotational direction restriction device comprises:

serrated teeth formed on an outer circumferential surface of the stick-on disk; and a locking tooth locking one of the serrated teeth in such a manner as to permit rotation of the stick-on disk in the direction identical to the rotational direction of the stick-on disk decentering jig and inhibit rotation of the stick-on disk in the direction opposite to the rotational direction of the stick-on disk decentering jig.

4. The plane polishing machine of claim 3, wherein the rotational direction restriction device comprises a pressing force regulator changing a pressing force of the locking tooth on the serrated teeth to thereby regulate a rotational resistance of the stick-on disk in the rotational direction of the stick-on disk decentering jig.

5. The plane polishing machine of claim 1, wherein the jig rotation suppression device interrupts a rotational force transmission path through which a rotational force is transmitted from the drive guide roller to the stick-on disk decentering jig, only for a predetermined rotational phase period of the jig rotation drive device.

6. The plane polishing machine of claim 5, wherein the jig rotation suppression device interrupts transmission of a driving force between the jig rotation drive device and the stick-on disk decentering jig only for a rotational phase period of the stick-on disk decentering jig during which a pivoting force of the stick-on disk generated by sliding contact with the polishing surface plate indicates a local maximum equal to or greater than a predetermined value wherein the pivoting force changes periodically due to rotation of the stick-on disk decentering jig.

7. The plane polishing machine of claim 1, wherein the jig rotation suppression device comprises a notch formed on an outer circumferential edge of the stick-on disk decentering jig, wherein the drive guide roller comes into contact with the notch when a rotation center of the polishing surface plate, a rotation center of the stick-on disk decentering jig, and a rotation center of the stick-on disk are aligned in a straight line.

* * * * *